US007080695B2

(12) United States Patent
Gwak

(10) Patent No.: US 7,080,695 B2
(45) Date of Patent: Jul. 25, 2006

(54) FIRE EXTINGUISHER

(75) Inventor: Jong-gi Gwak, Jeollanam-Do (KR)

(73) Assignee: Korea Safety.com., Ltd. (KR)

( * ) Notice: Subject to any disclaimer, the term of this patent is extended or adjusted under 35 U.S.C. 154(b) by 0 days.

(21) Appl. No.: 10/486,854

(22) PCT Filed: Aug. 17, 2002

(86) PCT No.: PCT/KR02/01559

§ 371 (c)(1),
(2), (4) Date: Aug. 26, 2004

(87) PCT Pub. No.: WO03/024532

PCT Pub. Date: Mar. 27, 2003

(65) Prior Publication Data

US 2005/0039930 A1 Feb. 24, 2005

(30) Foreign Application Priority Data

Aug. 17, 2001 (KR) ..... 2001-24923 U

(51) Int. Cl.
*A62C 11/00* (2006.01)
*A62C 37/50* (2006.01)
*B67D 5/08* (2006.01)

(52) U.S. Cl. ..... 169/30; 169/75; 239/71; 239/74; 73/129.2; 137/557

(58) Field of Classification Search ..... 169/30, 169/71, 75; 239/71, 74; 222/154; 220/DIG. 16; 73/729.1, 729.2, 730, 731; 137/557
See application file for complete search history.

(56) References Cited

U.S. PATENT DOCUMENTS

| | | | | | |
|---|---|---|---|---|---|
| 1,646,968 | A | * | 10/1927 | Louder | 73/713 |
| 3,675,722 | A | * | 7/1972 | Balmes, Sr. | 169/30 |
| 3,702,637 | A | * | 11/1972 | Bower | 169/75 |
| 4,088,194 | A | * | 5/1978 | Hard | 169/75 |
| 4,530,496 | A | * | 7/1985 | Smith et al. | 73/729.1 |
| 4,886,122 | A | * | 12/1989 | Goodnight | 169/74 |
| 6,125,940 | A | | 10/2000 | Oram | |

FOREIGN PATENT DOCUMENTS

| | | | |
|---|---|---|---|
| JP | 10-033708 | A | 2/1998 |
| JP | 10-305111 | A | 11/1998 |
| KR | 1999-0042154 | U | 12/1999 |

OTHER PUBLICATIONS

International Search Report for PCT/KR02/01559; ISA/KR; Mailed: Dec. 18, 2002.

* cited by examiner

*Primary Examiner*—David A. Scherbel
*Assistant Examiner*—Seth Barney
(74) *Attorney, Agent, or Firm*—Harness, Dickey & Pierce, P.L.C.

(57) ABSTRACT

The present invention relates to a fire extinguisher, in particular, to a fire extinguisher with an observation window formed in it, allowing to observe inside thereof so that one can easily confirm with naked eyes whether the extinguishing agent filled in the main body of the fire extinguisher is of prescribed quantity, or the extinguishing agent filled in is in an intact state, i.e. not hardened.

13 Claims, 5 Drawing Sheets

FIRE EXTINGUISHER

TECHNICAL FIELD OF THE INVENTION

The present invention relates to a fire extinguisher, in particular, to a fire extinguisher with an observation window formed in it, allowing to observe inside thereof so that one can easily confirm with naked eyes whether the extinguishing agent filled in the main body of the fire extinguisher is of prescribed quantity, or the extinguishing agent filled in is in an intact state, i.e. not hardened.

BACKGROUND ART

A fire extinguisher is an apparatus for extinguishing fire utilizing cooling effect or oxygen cut-off effect of fire extinguishing agents.

Fire extinguisher is classified by its extinguishing capacity into a heavy duty extinguisher with an extinguishing capacity of 10 or 20 units or more, or a small extinguisher with an extinguishing capacity of one unit or more, but lower than that of a heavy duty extinguisher. A small extinguisher is often employed at households, work places, offices, etc. due to its convenience in carriage and transport.

A fire extinguisher can also be classified by the type of extinguishing agents filled in the main body thereof, into an acid-alkali extinguisher, an enforcement liquid extinguisher, a halogen extinguisher, a carbon dioxide extinguisher, or a powder extinguisher, and the like. Since fire extinguishing agents are in general of high price, fire extinguisher using extinguishing agents other than powder extinguisher are employed normally only at specific sites.

A fire extinguisher can further be classified by the type of pressure it employs, into a pressure extinguisher or a accumulate pressure extinguisher.

A pressure extinguisher, being a conventional technology, comprises a pressure gas container (also called, a "cartridge") in the main body thereof where fire extinguishing agent is filled, as the container aims to press the extinguishing agent for injection. When a user presses two levers of the fire extinguisher until they are closely accessed to each other while the safety pin has been removed, the pressure gas container is opened, and the gas is released to press the extinguishing agent in the main body so that the extinguishing gas is injected out of the fire extinguisher.

However, a drawback of such pressure extinguisher is that its structure is complicated, because it requires a separate pressure gas container within the main body thereof, inclusive of a gas pipe for transmission of the pressure gas as well as an injection tube for the extinguishing agent.

Form this background, use of accumulate pressure extinguishers has been increased recently. For convenience of explanation, a fire extinguisher refers in the following description to a small powder fire extinguisher using accumulate pressure, if not mentioned otherwise.

An accumulate pressure type conventional fire extinguisher is consisted of a main body 110 with extinguishing agent and pressure gas filled in it, a head 120 installed at one end of the main body 110, two levers 122 fixed at the head 120, an extinguishing hose 130, one end of which is connected to the inside of the main body 110 while the other end is extended from the main body 110 to be exposed outward, and a nozzle fixed at one end of the extinguishing hose 130, as illustrated in FIG. 1.

At the two levers, a safety pin 124 is installed to prevent unintended access of the levers 122 to each other. Further, the head 120 is equipped with a pressure gauge 150 which indicates the pressure of the pressure gas consisted of nitrogen or carbon dioxide. The pressure gauge is one functioning mechanically with its indicator changing mechanically in accordance with the pressure changes inside of the main body 110.

In case fire occurs, a user removes the safety pin 124, presses the two levers firmly so that they are closely accessed, whereupon the extinguishing agent filled in the main body 110 is injected through the extinguishing hose 130 out of the nozzle 132, triggered by the pressure difference between high pressure in the tightly sealed main body 110 and low pressure atmosphere outside thereof.

However, since the main body of such conventional fire extinguisher is made of metal, it does not allow a user to confirm with naked eyes whether the extinguishing agent filled in is of prescribed quantity.

Another important factor for faultless functioning of such fire extinguisher is that the extinguishing agent filled in remain intact. In other words, the fire extinguisher fails to function when the extinguishing agent is hardened, even if the agent filled in is of sufficient quantity. A further problem with the conventional fire extinguisher is that it does not allow a user to confirm with his eyes whether the extinguishing agent filled in the main body thereof is in an intact state, i.e. not hardened.

Still another problem of the conventional fire extinguisher is that the pressure gauge installed at the lever part thereof to indicate the internal pressure of the main body is designed to function mechanically with a relatively high rate of malfunction, resulting in occasions when the fire extinguisher fails to function even if the inner pressure indicated by the gauge is normal. In addition, since such pressure gauge is exposed outward, it can easily be damaged by external force during carriage or transport.

DETAILED DESCRIPTION OF THE INVENTION

The present invention, conceived to solve the foregoing problems, aims to provide a fire extinguisher with an observation window formed in it, allowing to observe inside thereof so that one can easily confirm with naked eyes whether the fire extinguishing agent filled in the main body of the fire extinguisher is of prescribed quantity, or the agent filled in is in an intact state.

Another objective of the present invention is to provide a fire extinguisher with a non-mechanical pressure gauge installed adjacent to the observation window in the main body thereof, so that a user is allowed to easily confirm whether a prescribed level of pressure within the main body is maintained while the pressure gauge itself is freed from mechanical malfunction as well as damages by external force.

In order to achieve the above objectives, the present invention provides a fire extinguisher comprising a main body filled with prescribed quantity of extinguishing agent and pressure gas with prescribed level of pressure; a head combined with one end of the main body in a detachable manner; two levers installed at the above head; and an extinguishing hose, of which one end is connected to the inside of the main body while the other end is extended from the main body to be exposed outward to enable the extinguishing agent in the main body to be injected through it; wherein the above main body is consisted of an upper combining part with a thread formed at one end thereof to allow combination with the above head via a screw, a bottom support part, and a middle part stretching from the upper combining part to the bottom support part, the above middle part being equipped with an observation window formed along the length of the main body stretching from near the upper combining part to near the bottom support part allowing a user to observe the extinguishing agent filled in the main body.

The above observation window is formed by fixing a window made of a transparent material at the rear surface of a thru hole formed along the length of the middle part.

The rear surface of the middle part on which the edges of the observation window are to be placed, is curved outward and the edges of the observation window are sealed while they are placed on the correspondingly curved surface.

The transparent window is preferably made of polycarbonate (P/P) material in view of the strength of the material.

In the main body, a pressure gauge is installed at a location conveniently observable through the above observation window to indicate the pressure of the pressure gas filled in the main body.

The above pressure gauge comprises an elastic bag filled with indication liquid capable of expanding and contracting depending on the pressure of the pressure gas in the main body; and a closed transparent tube in the form of a long pipe with at least one scale marked at one side thereof, connected at one end to the above elastic bag to allow the indication liquid in the elastic bag to rise within the tube when the elastic bag contracts by the gas pressure in the main body.

If the above indication liquid reaches the standard level marked by the scale on the transparent tube through contraction of the elastic bag triggered by the gas pressure in the main body, this means that the gas pressure in the main body is maintained at an appropriate level.

The indication liquid may be colored appropriately for better observation.

Further, it is desirable that the above transparent observation window is equipped with a holder for holding the pressure gauge.

Figure 1:
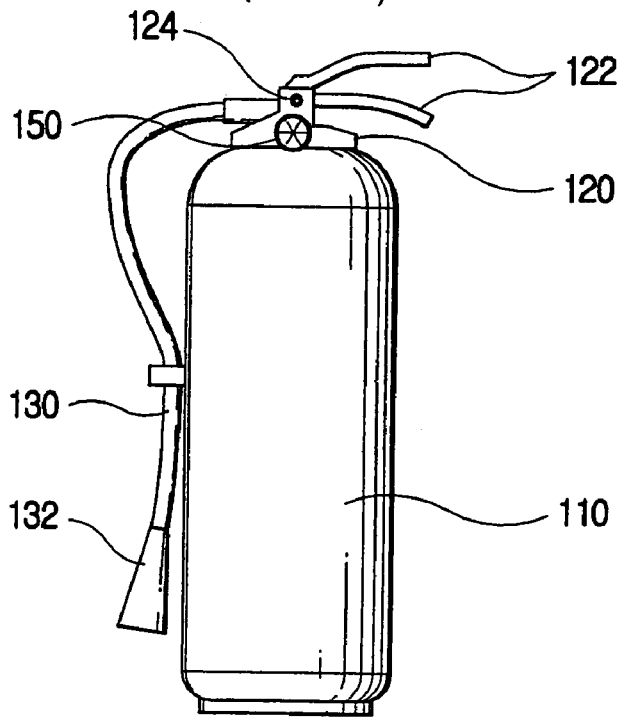
FIG 1 (Prior Art)
FIG. 1 is a front view of a conventional fire extinguisher.

The two levers 22 are fixed at one end on the axis of a hinge (not shown in the drawings) in a manner that they are allowed to access to or depart from each other. A safety pin 24 is provided near the hinge area for safe operation of the levers 22. To elaborate, a user has first to remove the safety pin 24 and then press the levers 22 until they are closely accessed to each other in order to operate the fire extinguisher.

The main body 10 is filled with fire extinguishing agent P of prescribed quantity and pressure gas with prescribed level of press. Although a large variety of agents can be used as fire extinguishing agent P, the present embodiment takes a filling of about ⅔ of the main body 10 with sodium bicarbonate powder having a fineness of 100 mesh or more as its standard. The pressure gas filled in the main body 10 may be nitrogen, carbon dioxide, and the like.

Figure 2:
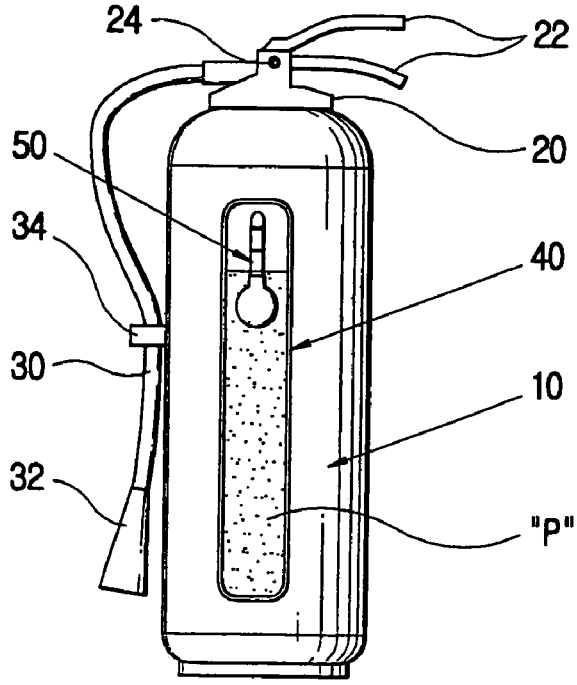
FIG. 2 is a front view of a fire extinguisher in accordance with an embodiment of the present invention. As shown in the drawing, the fire extinguisher in accordance with an embodiment of the present invention comprises a common main body 10; a head 20 combined with one end of the main body 10 in a detachable manner, two operating levers 22 installed at the above head 20; an extinguishing hose 30, of which one end is connected to the inside of the main body 10 while the other end is extended from the main body 10 to be exposed outward to enable the extinguishing agent in the main body 10 to be injected through it; and a nozzle 32 fixed at the outer end of the extinguishing hose 30. The extinguishing hose is held by a hose holder 34 provided at one side of the main body 10, when the fire extinguisher is not in use.
Figure 3A:
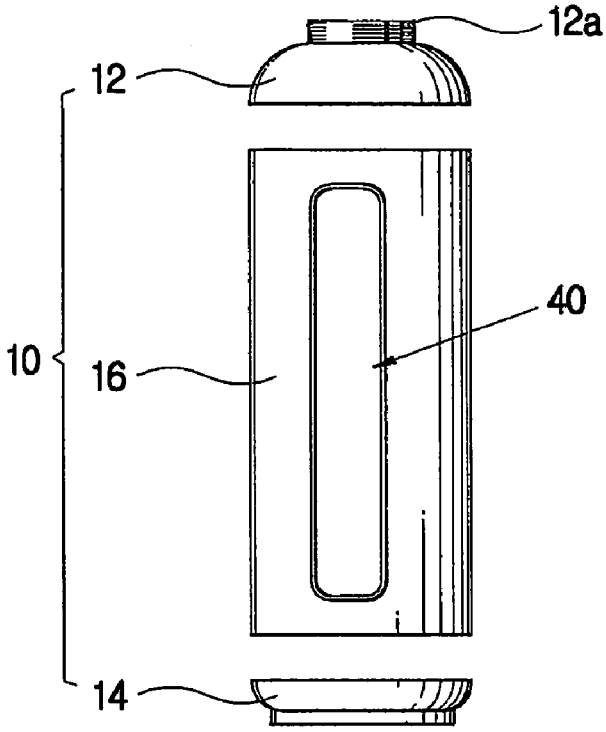
Figure 3B:
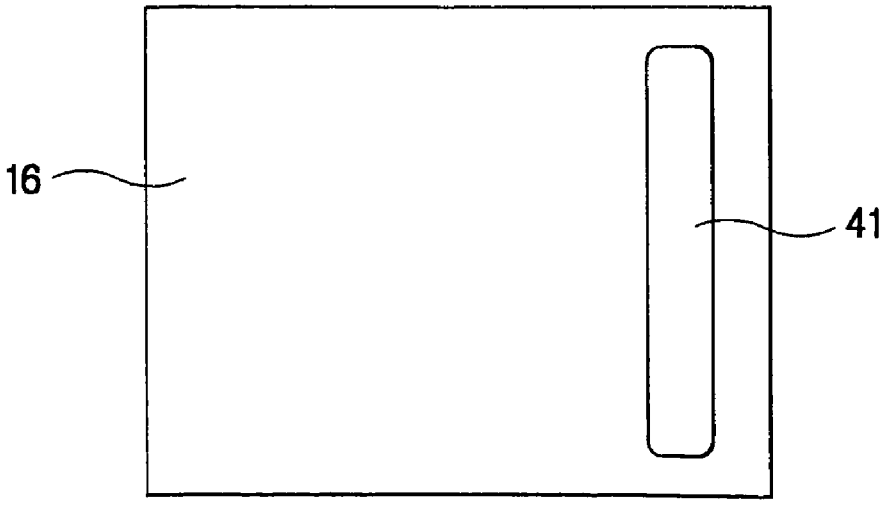

FIG. 3*a* is an exploded view of the main body of the fire extinguisher in FIG. 2, while FIG. 3*b* is a development view of the middle part of the main body of the fire extinguisher in FIG. 2. As illustrated in these drawings, the main body 10 is consisted of an upper combining part 12 for combination with the head 20, a bottom support part 14, and a middle part 16 stretching from the upper combining part 12 to the bottom support part 14, the upper combining part 12 being equipped with a thread 12*a* formed at one end thereof for combination with the head 20.

While the upper combining part 12 and the bottom support part 14 are formed in funnel shape with its top part cut off, the middle part 16 is manufactured by rolling a metal plate to result in a cylinder form (processing from FIG. 3*b* to a part of FIG. 3*a*). Manufacturing of the main body 10 is completed when the upper combing part 12 and the bottom support part 14 have been welded to the respective ends of the middle part 16.

The middle part 16 of the main body 10 is equipped with an observation window 40 formed along the length of the main body 10 stretching from near the upper combining part 12 to near the bottom support part 14 allowing a user to observe the extinguishing agent P filled in the main body 10.

Figure 4A:
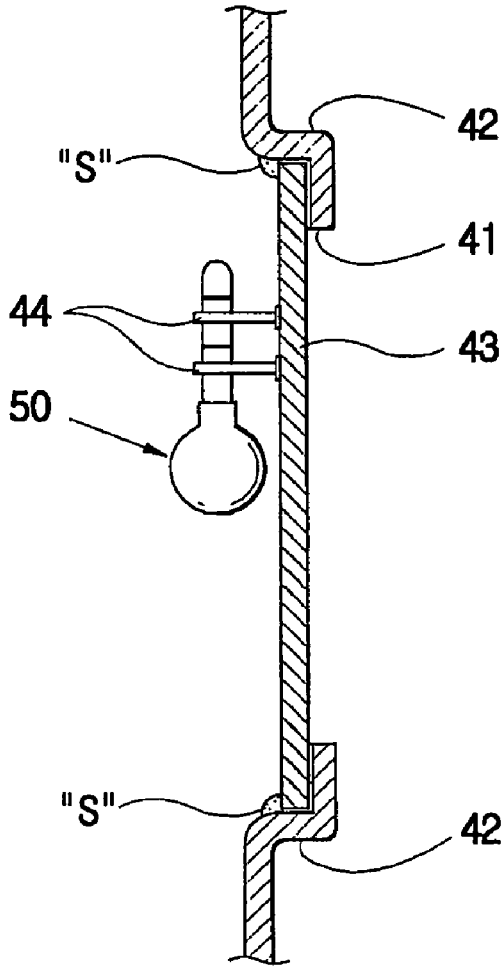

Although the observation window 40 can be made through various processes, the process adopted by an embodiment of the present invention is a simple one as shown in FIGS. 3*a*, 3*b*, and 4*a*. A thru hole 41 in shape of a long stripe is formed on the metal plate for the middle part 16, and then, the part of the thru hole to be jointed with the observation window 40 is slightly curved extruding forward from the middle part 16 to form a curved part 42, so that a transparent window 43 is placed on the rear surface of the thru hole 41.

Here, the transparent window 43 is placed in such a manner that every edge thereof exactly fits the curved part 42 formed in the middle part as illustrated in FIG. 4*a*, and then, it is tightly sealed S with the curved part 42, with which procedure the manufacturing process of an observation window 40 is completed. A polycarbonate (P/P) material is used for the transparent window 43 in this embodiment.

With such an observation window 40, it can easily be confirmed with naked eyes whether a prescribed quantity of extinguishing agent P (approximately ⅔ of the inner volume of the main body 10) is filled in the main body 10. Since the observation window 40 of the present embodiment is formed along the height of the fire extinguisher, it allows a better observation of the fill status of the extinguishing agent P in the main body 10.

Further, this observation window 40 allows a user to easily confirm whether the extinguishing agent P filled in the main body 10 is hardened, by simply shading or upsetting the fire extinguisher. If the extinguishing agent P has become hardened, it shall be substituted appropriately.

As illustrated in FIG. 2, a pressure gauge 50 for indicating pressure of the pressure gas filled in the main body 10 is installed at a location in the main body 10 observable from outside of the main body 10 through the observation window 40, in contrast to a conventional fire extinguisher, where a pressure gauge 150 is installed at the head 120, which is vulnerable to damages caused by outer force. The present invention, by installing a pressure gauge 50 in the main body 10 at a location observable through the observation window 40 in one embodiment example thereof, can effectively prevent damage of the pressure gauge 50.

In addition, the above embodiment of the present invention is capable of preventing a malfunction of the pressure gauge 50, by adopting a functional principle different from the mechanical functioning in a conventional pressure gauge 150, as described below.

Figure 4B:
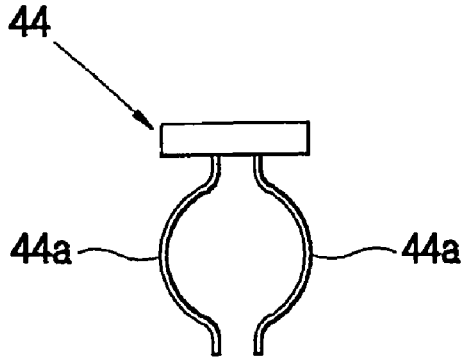

As shown in FIG. 4*b*, the observation window 40 is equipped with a pair of holders 44 for holding the pressure gauge 50. The holders 44, having an opening at one side, hold the pressure gauge 50 firmly by elastically pressing the same from both sides with the holding arms 44*a*, 44*b*. However, other types of fixing the pressure gauge 44 using screws, hooks, elastic band, etc. other than holders may also be adopted.

Figure 5A:
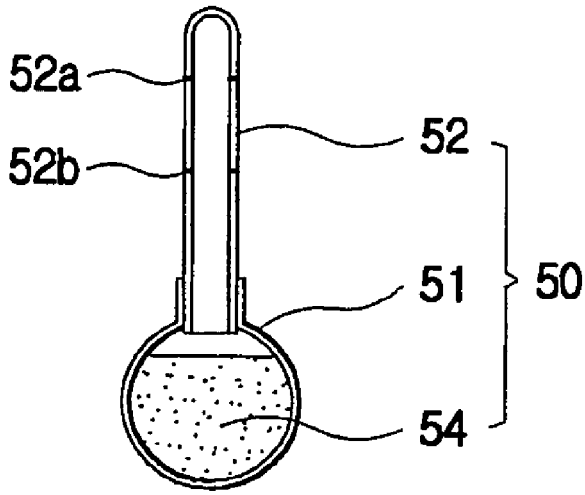
Figure 5B:
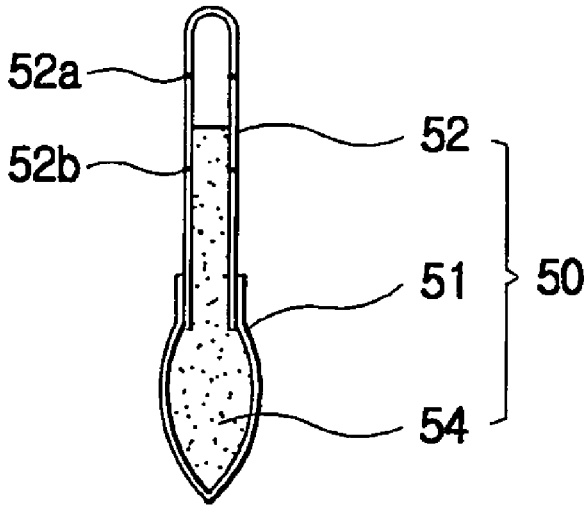

The pressure gauge 50 adopted by an embodiment of the present invention comprises, as illustrated in FIGS. 5*a* and 5*b*, an elastic bag 51 filled with indication liquid 54 capable of expanding and contracting depending on the pressure of the pressure gas in the main body; and a closed transparent tube 52 in the form of a long pipe with two scales 52*a*, 52*b* marked at one side thereof connected at one end to the above elastic bag 51 to allow the indication liquid 54 in the elastic bag 51 to rise within the tube 52 when the elastic bag contracts by the gas pressure in the main body 10.

The indication liquid 54, since it has be non-contracting liquid, is preferably of water. However, since water is without any color, it is not easily observable. Thus, the present embodiment employs a colored indication liquid 54, to enable easy observation Commonly, the indication liquid is colored in green.

The elastic bag 51 is made of pure rubber, preferably of a latex material this material being not only chemically stable, but also durable and flexible. The height of the indication liquid 54 in the closed tube 52 can be controlled by manipulation of the size and/or the thickness of the elastic bag 51.

The scales 52*a*, 52*b*, being marked at the closed tube 52 with a predetermined distance to each other as shown in the drawing, indicates that pressure of the pressure gas is in a prescribed range when the indicating liquid 54 is located between the two scales 52*a* and 52*b*.

The pressure of the pressure gas in the main body 10 shall normally range about 9 kg/m$^3$. The elastic bag 51 contracts by pressure of the pressure gas, which behavior triggers the indication liquid 54 to rise in the closed tube 52, whereby the indication liquid 54 remains between the two scales 52*a* and 52*b* marked at the closed tune 52, if the pressure is in a normal state.

Since the indication liquid 54 located between the scales 52*a* and 52*b* indicates that the pressure is maintained in an appropriate range, a user can easily confirm the normal state of the pressure gas in the main body 10 through a simple observation of the observation window 40.

An observation of the observation window 40 not only allows to confirm whether the pressure of the pressure gas in normal range, but also to confirm whether the extinguishing agent is in an intact state, i.e. whether it is hardened.

Furthermore, the non-mechanical pressure gauge 50 installed in the main body 10 allows not only to confirm whether pressure of the pressure gas in the main body 10 is in the normal range, but also to prevent malfunction of the gauge 50 as well as damage thereof by outer force.

As described above in connection with FIG. 4*a*, the holders 44 hold the closed tube 52 of the pressure gauge 50 firmly by elastically pressing from both sides with the holding arms 44*a*, 44*b*. However, the closed tube 52 of the pressure gauge 52 can be held more firmly, if it is supported by an additional latch 53 provided at the holder 44, allowing the closed tube 52 not to slip downward.

In the example illustrated in FIG. 4*a*, the pressure gauge 50 is installed with a certain distance from the transparent window 43. In such case, there can be instances where the pressure gauge 50 becomes invisible when it is hidden by the extinguishing agent P.

Figure 6:
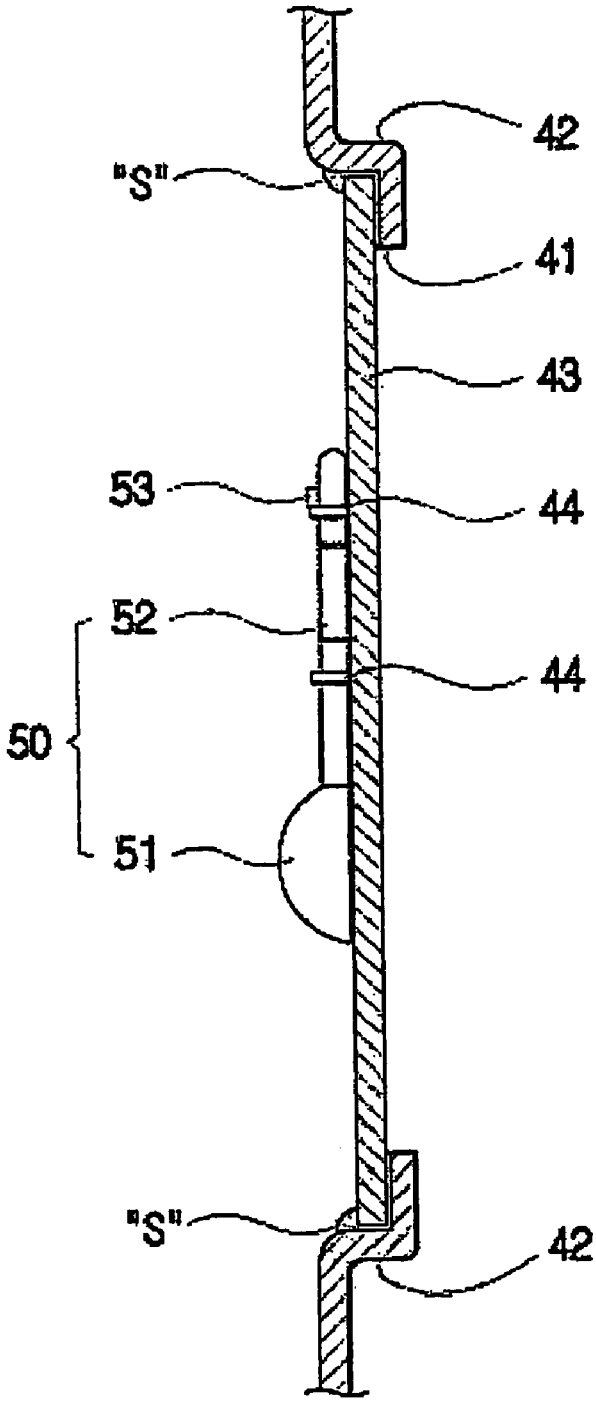

Thus, another embodiment of the present invention as illustrated in FIG. 6 provides the pressure gauge 50 to be placed directly at the rear surface of the transparent window 43, so that no extinguishing agent P can be filled in the space between the pressure gauge 50 and the transparent window 43, to guarantee sure observation of the pressure gauge 50. In addition, the close tube 52 is preferably be made as a lengthy tube to provide a wide observation space between the scales, allowing a comfortable observation.

INDUSTRIAL APLICABILITY

As described above, the present invention provides an observation window that allows to confirm with naked eyes not only whether the extinguishing agent filled in is of a prescribed quantity, but also whether the extinguishing agent filled in is in an intact state, i.e. not in a hardened state.

Further, the present invention provides a non-mechanical pressure gauge installed in the main body of a fire extinguisher, allowing not only an easy confirmation whether pressure of the pressure gas in the main body is maintained in normal range, but also to prevent malfunction of the pressure gauge as well as damages by outer force.

What is claimed is:

1. A fire extinguisher, comprising:

a main body filled with a prescribed quantity of extinguishing agent and pressure gas with a prescribed level of pressure;

a head detachably fastened to an end of the main body;

a pair of levers provided at predetermined portions of the head; and an extinguishing hose, with a first end of the extinguishing hose communicating with an inside of the main body while a second end of the extinguishing hose extending to an outside of the main body, thus allowing the extinguishing agent to be injected to the outside of the main body through the extinguishing hose;

wherein the main body comprises:

an upper combining part having at a first end thereof a thread to allow the head to be fastened to the upper combining part in a screw-type fastening method;

a bottom support part supported on a support surface; and a middle part provided between the upper combining part and the bottom support part, the middle part comprising:

an observation window longitudinally provided along a sidewall of the middle part of the main body so that opposite ends of the observation window are placed near the upper combining part and the bottom support part, respectively, the observation window allowing a user to observe the extinguishing agent filled in the main body; and a pressure gauge provided in the middle part of the main body so that the user observes the pressure gauge through the observation window, the pressure gauge being elastically deformed by the pressure of the pressure gas filled in the main body, thus indicating the pressure of the pressure gas.

2. The fire extinguisher according to claim 1, wherein the observation window comprises:

a thru hole longitudinally provided along the middle part; and a transparent window mounted on an inner surface of the middle part at a position to correspond to the thru hole.

3. The fire extinguisher according to claim 2, wherein the transparent window further comprises at least one holder to hold the pressure gauge.

4. The fire extinguisher according to claim 2, wherein the inner surface of the middle part on which edges of the transparent window are to be placed, is curved outward to form curved parts, and the edges of the transparent window are sealed while being placed on the corresponding curved parts.

5. The fire extinguisher according to claim 4, wherein the transparent window is made of a polycarbonate (P/P) material.

6. The fire extinguisher according to claim 1, wherein the pressure gauge comprises:

an elastic bag filled with indication liquid, the elastic bag expanding and contracting depending on the pressure of the pressure gas in the main body; and a transparent closed tube having a form of a long pipe with at least one scale marked at a side of the closed tube, the transparent closed tube connected at a first end thereof to the elastic bag to allow the indication liquid contained in the elastic bag to rise into the tube when the elastic bag contracts by the pressure gas in the main body.

7. The fire extinguisher according to claim 6, wherein the indication liquid is colored for better observation.

8. A fire extinguisher, comprising:

a main body filled with a prescribed quantity of extinguishing agent and pressure gas with a prescribed level of pressure;

a head detachably fastened to an end of the main body;

a pair of levers provided at predetermined portions of the head; and an extinguishing hose, with a first end of the extinguishing hose communicating with an inside of the main body while a second end of the extinguishing hose extending to an outside of the main body, thus allowing the extinguishing agent to be injected to the outside of the main body through the extinguishing hose;

wherein the main body comprises:

an upper combining part having at a first end thereof a thread to allow the head to be fastened to the upper combining part in a screw-type fastening method;

a bottom support part supported on a support surface; and a middle part provided between the upper combining part and the bottom support part, the middle part comprising:

an observation window longitudinally provided along a sidewall of the middle part of the main body so that opposite ends of the observation window are placed near the upper combining part and the bottom support part, respectively, the observation window allowing a user to observe the extinguishing agent filled in the main body, the observation window comprising a thru hole longitudinally provided along the middle part and a transparent window mounted on an inner surface of the middle part at a position to correspond to the thru hole; and a pressure gauge provided in the middle part of the main body so that the user observes the pressure gauge through the observation window, the pressure gauge being elastically deformed by the pressure of the pressure gas filled in the main body, thus indicating the pressure of the pressure gas.

9. The fire extinguisher according to claim 8, wherein the inner surface of the middle part on which edges of the transparent window are to be placed, is curved outward to form curved parts, and the edges of the transparent window are sealed while being placed on the corresponding curved parts.

10. The fire extinguisher according to claim 9, wherein the transparent window is made of a polycarbonate (P/P) material.

11. The fire extinguisher according to claim 8, wherein the pressure gauge comprises:

an elastic bag filled with indication liquid, the elastic bag expanding and contracting depending on the pressure of the pressure gas in the main body; and a transparent closed tube having a form of a long pipe with at least one scale marked at a side of the closed tube, the transparent closed tube connected at a first end thereof to the elastic bag to allow the indication liquid contained in the elastic bag to rise into the tube when the elastic bag contracts by the pressure gas in the main body.

12. The fire extinguisher according to claim 11, wherein the indication liquid is colored for better observation.

13. The fire extinguisher according to claim 8, wherein the transparent window further comprises at least one holder to hold the pressure gauge.

* * * * *